US006091036A

United States Patent [19]

Hu

[11] Patent Number: 6,091,036

[45] Date of Patent: Jul. 18, 2000

[54] KEYSWITCH FOR COMPUTER KEYBOARDS

[75] Inventor: Gino Hu, Taipei, Taiwan

[73] Assignee: Silitek Corporation, Taipei, Taiwan

[21] Appl. No.: 09/419,628

[22] Filed: Oct. 18, 1999

[51] Int. Cl.[7] ..... H01H 13/70

[52] U.S. Cl. ..... 200/344

[58] Field of Search ..... 200/5 A, 512, 200/517, 344, 345; 400/490, 491, 491.2, 495, 495.1, 496

[56] References Cited

U.S. PATENT DOCUMENTS

| | | | |
|---|---|---|---|
| 5,630,501 | 5/1997 | Tsay | 200/344 |
| 5,767,468 | 6/1998 | Tsai | 200/344 |
| 5,823,324 | 10/1998 | Tsai | 200/344 |
| 5,829,579 | 11/1998 | Tsai | 200/344 |
| 5,874,696 | 2/1999 | Hayashi et al. | 200/5 A |
| 5,947,616 | 9/1999 | Liang | 400/491.2 |

*Primary Examiner*—Michael Friedhofer
*Attorney, Agent, or Firm*—Rosenberg, Klein & Lee

[57] ABSTRACT

A keyswitch is provided that comprises a key top, a rubber cone, a first lever, a second lever, and a base. An operation surface and an assembly surface respectively form at the top end and the bottom end of the key top. A penetrating accommodation room is installed on the base. The rubber cone is installed between the key top and the base. The first lever and the second lever are installed between the assembly surface of the key top and the base. The two levers are in scissors arrangement. The top ends of the two levers are connected to the assembly surface of the key top. The bottom ends of the two levers are connected to the base. The accommodation room is disposed below the two levers. A bottom board is installed at the bottom of the base. When the two levers are jointly moved downwards via the key top, they can sink into the accommodation room. A low-profile keyswitch can be acquired under the condition of the same key pressing stroke. The compactness requirement of modern products can thus be achieved.

4 Claims, 4 Drawing Sheets

KEYSWITCH FOR COMPUTER KEYBOARDS

FIELD OF THE INVENTION

The present invention relates to a keyswitch for computer keyboards, especially to a low-profile keyswitch that fits the compactness requirement of modern products, and thus is suitable for keyboards of notebook computers.

BACKGROUND OF THE INVENTION

As shown in FIG. 1, the conventional keyswitch 10 of computer keyboards comprises a key top 11*a*, a rubber cone 12*a*, a first lever 13*a*, a second lever 14*a*, a base 16*a*, and a bottom board 22*a*. The first lever 13*a* and the second lever 14*a* are in scissors arrangement. Shafts 18*a* and 19*a* at the bottom ends of the first lever 13*a* and the second lever 14*a* are respectively pivotally arranged within pivotal grooves 20*a* and 21*a* installed at the top of the base 16*a*. The top ends of the first lever 13*a* and the second lever 14*a* are connected to the key top 11*a*. The first lever 13*a* and the second lever 14*a* form a jointly moving mechanism. The rubber cone 12*a* is disposed within the key pressing stroke of the key top 11*a*. When the key top 11*a* is guided to move upwards or downwards via the two levers 13*a* and 14*a*, the rubber cone 12*a* can press or leave a membrane circuit 15*a* to let a switch be on or off. However, the keyswitch 10*a*, the base 16*a*, the first lever 13*a*, and the second lever 14*a* all have a certain thickness such that the total height of the keyswitch 10*a* is increased. The compactness requirement of modern products can not be achieved.

SUMMARY AND OBJECTS OF THE PRESENT INVENTION

Accordingly, the primary object of the present invention is to provide a keyswitch comprising a key top, a rubber cone, a first lever, a second lever, and a base, which is characterized in that a penetrating accommodation room is installed on the base. The accommodation room is disposed below the first and the second levers. When the two levers are jointly moved downwards via the key top, they can sink into the accommodation room. A low-profile keyswitch can be acquired under the condition of the same key pressing stroke. The compactness requirement of modern products can thus be achieved.

The various objects and advantages of the present invention will be more readily understood from the following detailed description when read in conjunction with the appended drawing, in which:

DETAILED DESCRIPTION OF PREFERRED EMBODIMENT

Figure 1:
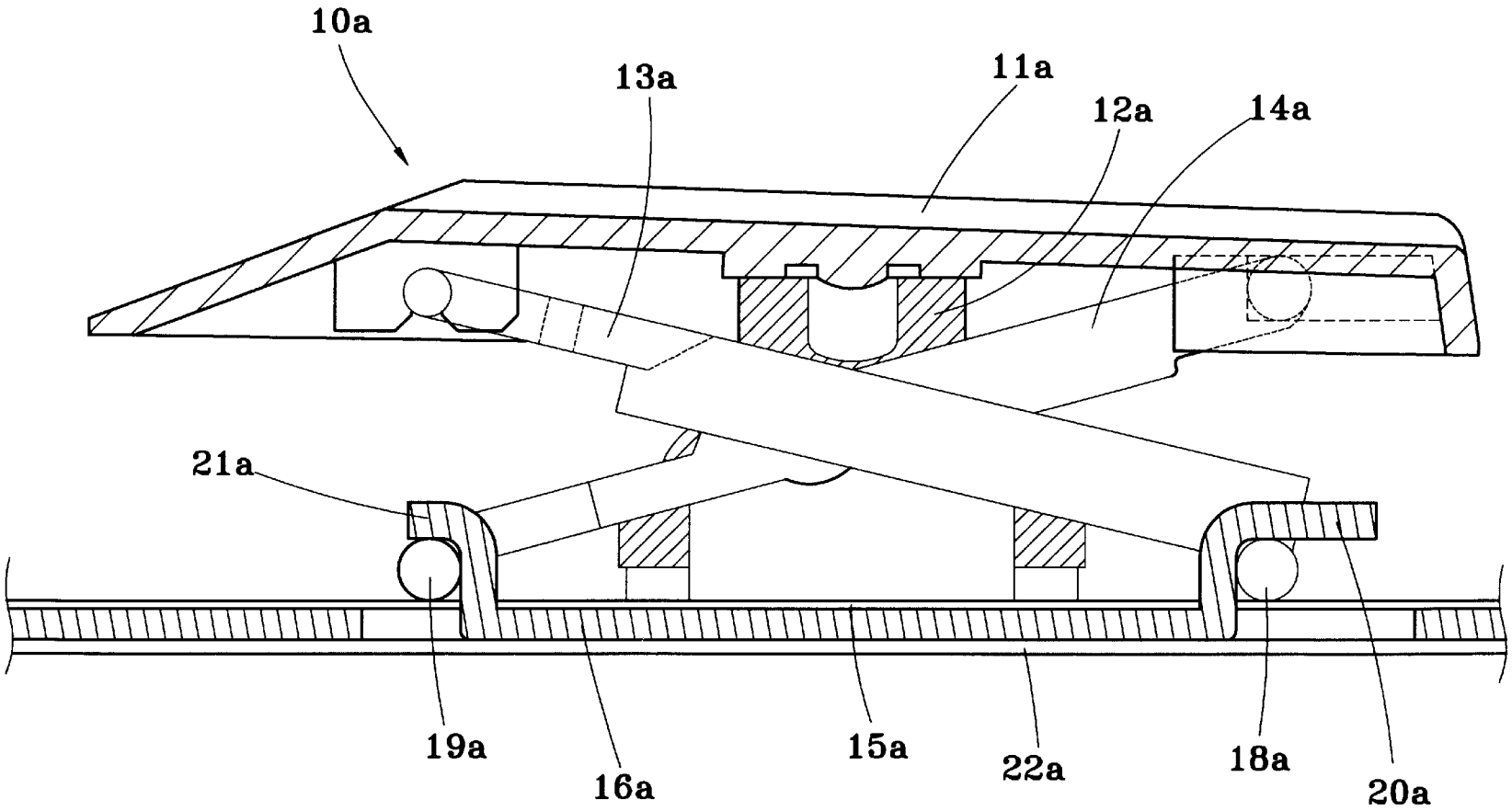
FIG.1 PRIOR ART
FIG. 1 is a cross-sectional view of the conventional keyswitch.
Figure 2:
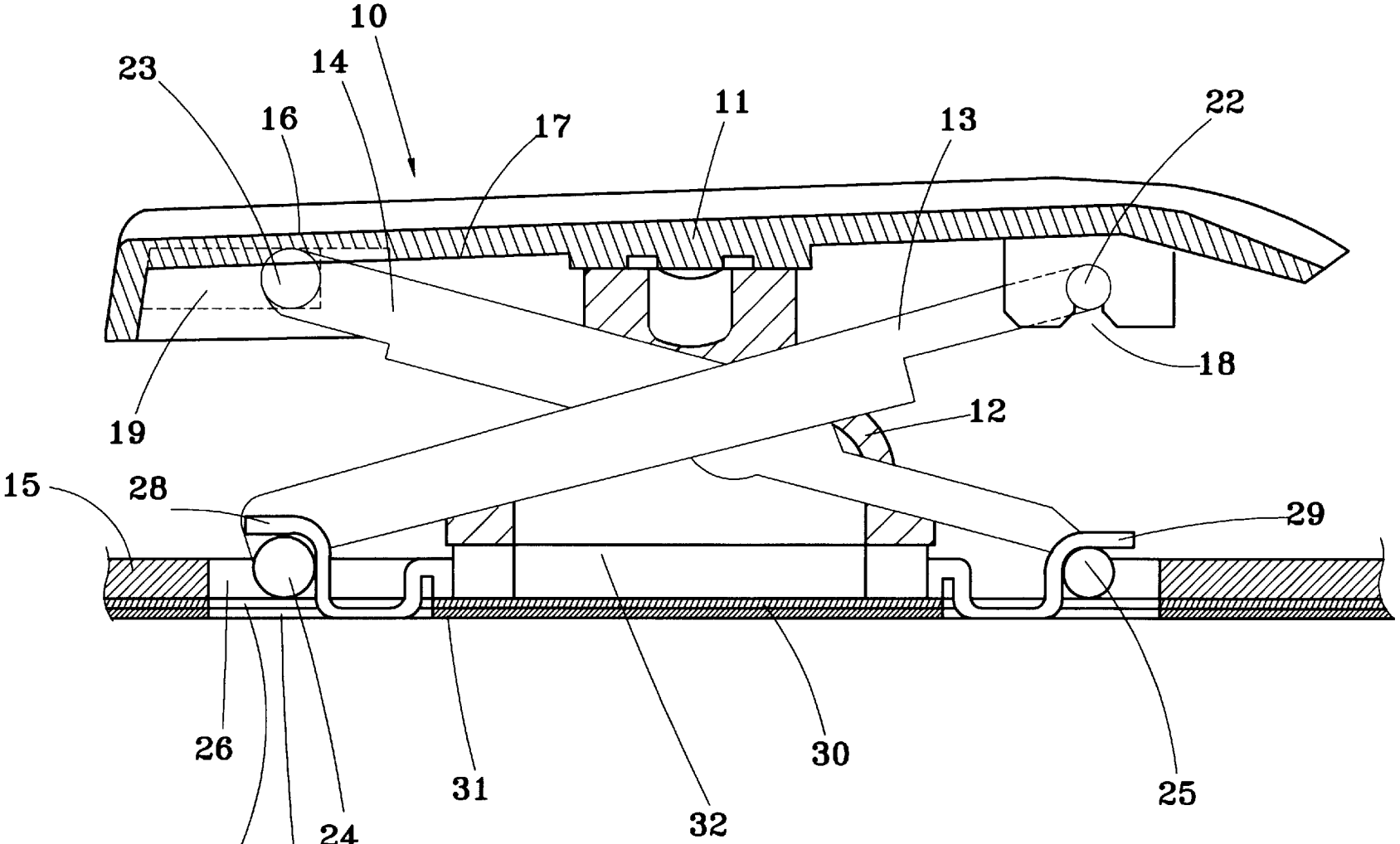
FIG. 2 is a cross-sectional view of the keyswitch of the present invention.
Figure 3:
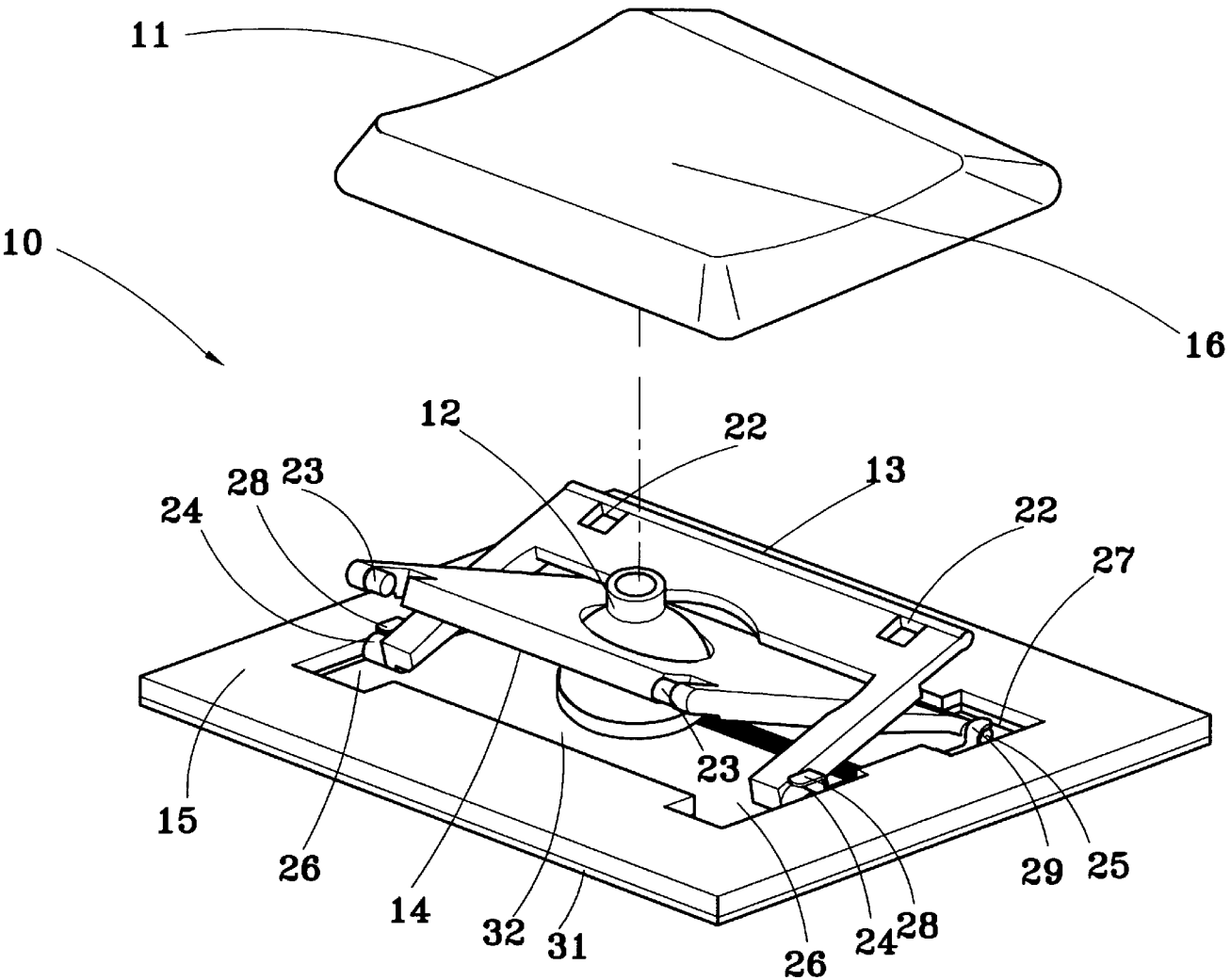
FIG. 3 is a perspective assembly view of the keyswitch of the present invention.
Figure 4:
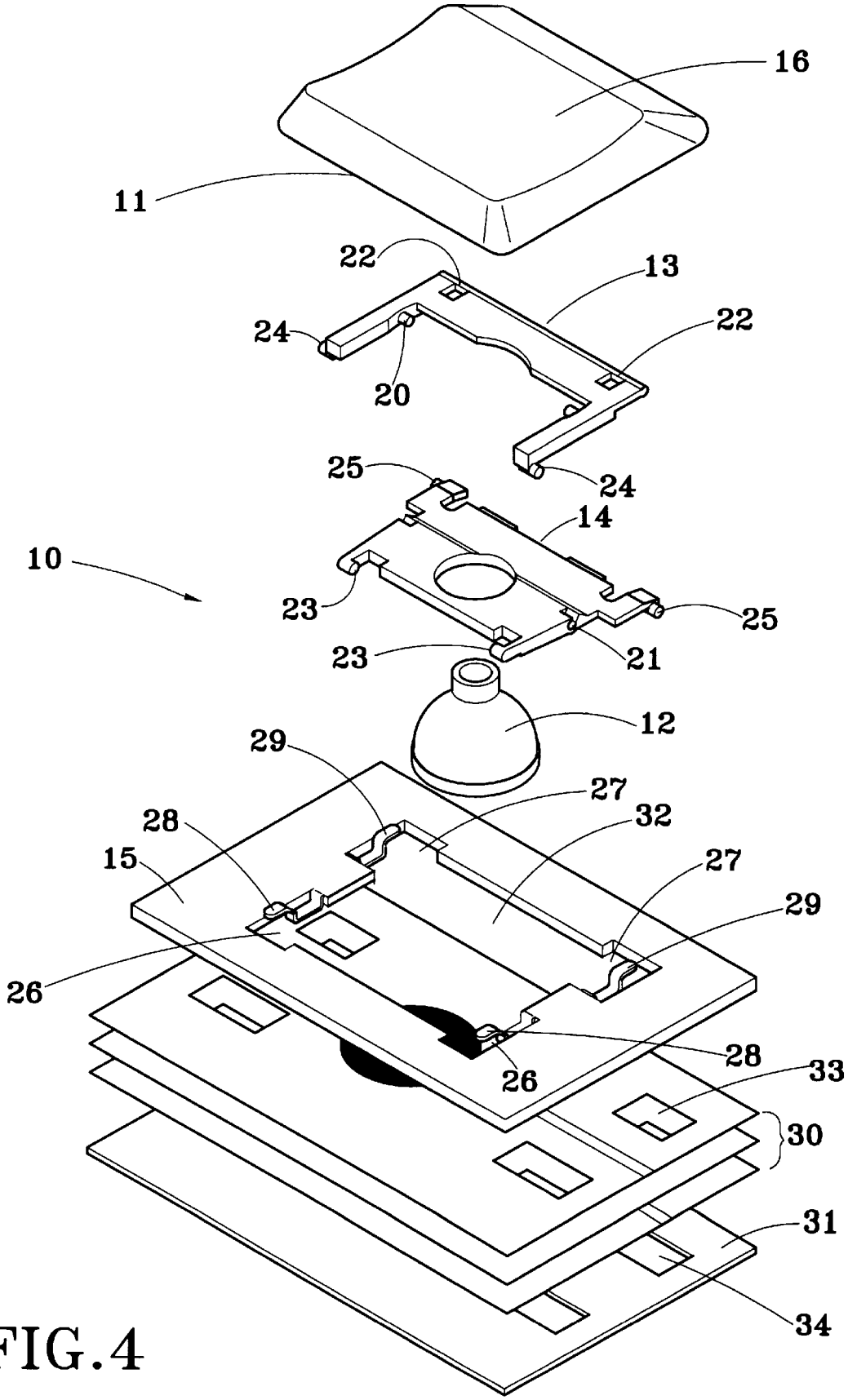
FIG. 4 is a perspective disassembly view of the keyswitch of the present invention.

As shown in FIGS. 2 to 4, a keyswitch 10 of the present invention comprises a key top 11, a rubber cone 12, a first lever 13, a second lever 14, and a base 15. The key top is a generally quadratic cap with an operation surface 16 and an assembly surface 17 formed respectively at the top end and the bottom end thereof. Two pivotal holes 18 and two slide grooves 19 are disposed on the assembly surface 17.

The first lever 13 and the second lever 14 are installed between the assembly surface 17 of the key top 11 and the base 15. Corresponding shafts 20 and pivotal holes 21 are respectively installed at the central part of two sides of the first lever 13 and the second lever 14 to let them be pivotally in scissors arrangement and form a jointly-moving mechanism.

The rubber cone 12 is installed between the key top 11 and the base 15. The rubber cone 12 is disposed within the key pressing stroke of the key top 11. A shaft 22 is installed at the top end of each side of the first lever 13. A slide shaft 23 is installed at the top end of each side of the second lever 14. The first lever 13 is pivotally arranged within the pivotal holes 18 of the key top 11 via the shafts 22 at the top ends of both sides thereof. The second lever 14 is slidably matched to the slide groove 19 of the key top 11 via the slide shafts 23 at the top ends of both sides thereof. The top ends of the first lever 13 and the second lever 14 are thus connected to the assembly surface 17 of the key top 11.

Shafts 24 and 25 respectively installed at the bottom ends of the first lever 13 and the second lever 14 are pivotally arranged within holes 26 and 27 of the base 15. Positioning plates 28 and 29 are respectively installed above the holes 26 and 27 to limit upward movement of the shafts 24 and 25. A membrane circuit and a bottom board 31 are installed at the bottom of the base 15. Holes 33 and 34 corresponding to the shafts 24 and 25 are respectively disposed at the membrane circuit 30 and the bottom board 31. When the key top 11 is guided to move upwards and downwards via the two levers 13 and 14, the rubber cone 12 below the key top 11 can press or leave the membrane circuit 30 to let a switch be on or off.

The present invention is characterized in that a penetrating accommodation room 32 is installed on the base 15. The accommodation room 32 is disposed below the first lever 13 and the second lever 14 to accommodate them. When the two levers 13 and 14 are jointly moved downwards by the key top 11, they can sink in the accommodation room 32. The thickness of the keyswitch 10 can be reduced under the condition of the same key pressing stroke. A low-profile keyswitch can be acquired such that the compactness requirement of modern products are achieved. Moreover, the first lever 13 and the second lever 14 can be assembled from below except from above the base 15, resulting in easier assembly and lower cost.

Although the present invention has been described with reference to the preferred embodiment thereof, it will be understood that the invention is not limited to the details thereof. Various substitutions and modifications have suggested in the foregoing description, and other will occur to those of ordinary skill in the art. Therefore, all such substitutions and modifications are intended to be embraced within the scope of the invention as defined in the appended claims.

I claim:

1. A keyswitch comprising:

a key top having an operation surface and an assembly surface respectively formed at a top end and a bottom end thereof;

a base;

a rubber cone installed between said key top and said base;

a first lever and a second lever installed between said assembly surface of said key top and said base, said first and second levers being pivotally joined in a scissors arrangement, each of said first and second levers having a top end connected to said assembly surface of said key top and a bottom end connected to said base; and a bottom board installed at a bottom of said base;

said base having a centrally disposed through opening formed below said first and second levers to accommodate said first and second levers therein such that when said first and second levers are jointly moved downwards via said key top, said first and second levers can be displaced into said accommodation room to thereby permit a thickness of said keyswitch to be reduced.

2. The keyswitch of claim 1 wherein said base has a plurality of holes formed therein and a positioning plate installed above each of said plurality of holes, said bottom end of each of said first and second levers having a shaft formed on opposing sides thereof pivotally arranged within a respective one of said plurality of holes of said base.

3. A keyswitch comprising:

a key top having an operation surface and an assembly surface respectively formed at a top end and a bottom end thereof;

a base having a plurality of holes formed therein and a positioning plate installed above each of said plurality of holes;

a rubber cone installed between said key top and said base;

a first lever and a second lever installed between said assembly surface of said key top and said base, said first and second levers being pivotally joined in a scissors arrangement, the top ends each of said first and second levers having a top end connected to said assembly surface of said key top and a bottom end connected to said base, said bottom end of each of said first and second levers having a pair of shafts respectively formed on opposing sides thereof pivotally arranged within a respective one of said plurality of holes of said base; and, a bottom board installed at a bottom of said base, said bottom board having a plurality of holes formed therein corresponding to said pair of shafts of each of said first and second levers;

said base having a centrally disposed through opening formed below said first and second levers to accommodate said first and second levers therein such that when said first and second levers are jointly moved downwards via said key top, said first and second levers can be displaced into said accommodation room to thereby permit a thickness of said keyswitch to be reduced.

4. A keyswitch comprising:

a key top having an operation surface and an assembly surface respectively formed at a top end and a bottom end thereof;

a base having a plurality of holes formed therein and a positioning plate installed above each of said plurality of holes;

a rubber cone installed between said key top and said base;

a first lever and a second lever installed between said assembly surface of said key top and said base, said first and second levers being pivotally joined in a scissors arrangement, the top ends each of said first and second levers having a top end connected to said assembly surface of said key top and a bottom end connected to said base, said bottom end of each of said first and second levers having a pair of shafts respectively formed on opposing sides thereof pivotally arranged within a respective one of said plurality of holes of said base;

a bottom board installed at a bottom of said base; and, a membrane circuit disposed between said base and said bottom board, said membrane circuit having a plurality of holes formed therein in correspondence with said plurality of holes of said base;

said base having a centrally disposed through opening formed below said first and second levers to accommodate said first and second levers therein such that when said first and second levers are jointly moved downwards via said key top, said first and second levers can be displaced into said accommodation room to thereby permit a thickness of said keyswitch to be reduced.

* * * * *